US011169460B2

(12) United States Patent
Kototani et al.

(10) Patent No.: US 11,169,460 B2
(45) Date of Patent: Nov. 9, 2021

(54) TONER

(71) Applicant: CANON KABUSHIKI KAISHA, Tokyo (JP)

(72) Inventors: Shohei Kototani, Suntou-gun (JP); Kentaro Yamawaki, Mishima (JP); Tsuneyoshi Tominaga, Suntou-gun (JP); Masatake Tanaka, Yokohama (JP); Taiji Katsura, Suntou-gun (JP); Masamichi Sato, Mishima (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 16/728,157

(22) Filed: Dec. 27, 2019

(65) Prior Publication Data

US 2020/0209776 A1 Jul. 2, 2020

(30) Foreign Application Priority Data

Dec. 28, 2018 (JP) ..... JP2018-246948

(51) Int. Cl.
*G03G 9/08* (2006.01)
*G03G 9/097* (2006.01)
*G03G 9/087* (2006.01)

(52) U.S. Cl.
CPC ..... *G03G 9/09775* (2013.01); *G03G 9/0819* (2013.01); *G03G 9/08711* (2013.01)

(58) Field of Classification Search
CPC ..... G03G 9/097; G03G 9/09708; G03G 9/09725; G03G 9/09775
See application file for complete search history.

(56) References Cited

U.S. PATENT DOCUMENTS

| | | | |
|---|---|---|---|
| 7,833,685 | B2 | 11/2010 | Tanaka et al. |
| 8,372,573 | B2 | 2/2013 | Ayaki et al. |
| 8,377,616 | B2 | 2/2013 | Tani et al. |
| 8,383,313 | B2 | 2/2013 | Ayaki et al. |
| 8,551,680 | B2 | 10/2013 | Ayaki et al. |
| 8,628,899 | B2 | 1/2014 | Kawamura et al. |
| 8,815,484 | B2 | 8/2014 | Tanaka et al. |
| 9,158,216 | B2 | 10/2015 | Shimano et al. |
| 9,341,967 | B2 | 5/2016 | Tsujino et al. |
| 9,366,981 | B2 | 6/2016 | Yamawaki et al. |
| 9,377,705 | B2 | 6/2016 | Shimano et al. |
| 9,383,668 | B2 | 7/2016 | Noji et al. |
| 9,423,708 | B2 | 8/2016 | Tominaga et al. |
| 9,500,972 | B2 | 11/2016 | Tanaka et al. |
| 9,575,424 | B2 | 2/2017 | Nakagawa et al. |
| 9,599,919 | B2 | 3/2017 | Isono et al. |
| 9,632,441 | B2 | 4/2017 | Abe et al. |
| 9,658,549 | B2 | 5/2017 | Tanaka et al. |
| 9,720,340 | B2 | 8/2017 | Tominaga et al. |
| 9,733,583 | B2 | 8/2017 | Kuroki et al. |
| 9,733,584 | B2 | 8/2017 | Masumoto et al. |
| 9,785,071 | B2 | 10/2017 | Shimano et al. |
| 9,785,077 | B2 | 10/2017 | Abe et al. |
| 9,829,816 | B2 | 11/2017 | Tanaka et al. |
| 9,829,820 | B2 | 11/2017 | Masumoto et al. |
| 9,835,964 | B2 | 12/2017 | Yoshida et al. |
| 9,897,932 | B2 | 2/2018 | Hotta et al. |
| 9,904,193 | B2 | 2/2018 | Nakagawa et al. |
| 9,921,501 | B2 | 3/2018 | Mochizuki et al. |
| 9,958,801 | B2 | 5/2018 | Tanaka et al. |
| 10,054,866 | B2 | 8/2018 | Tanaka et al. |
| 10,114,303 | B2 | 10/2018 | Katsura et al. |
| 10,429,757 | B2 | 10/2019 | Yoshida et al. |
| 10,503,090 | B2 | 12/2019 | Tominaga et al. |
| 10,545,422 | B2 | 1/2020 | Yamawaki et al. |
| 2004/0058258 | A1 | 3/2004 | Yoshino et al. |

(Continued)

FOREIGN PATENT DOCUMENTS

| | | |
|---|---|---|
| EP | 0 430 076 | 6/1991 |
| EP | 2 669 740 | 12/2013 |

(Continued)

OTHER PUBLICATIONS

U.S. Appl. No. 16/670,352, Kentaro Yamawaki, filed Oct. 31, 2019.
U.S. Appl. No. 16/728,050, Tsuneyoshi Tominaga, filed Dec. 27, 2019.
U.S. Appl. No. 16/728,060, Kentaro Yamawaki, filed Dec. 27, 2019.
U.S. Appl. No. 16/728,082, Yasuhiro Hashimoto, filed Dec. 27, 2019.
U.S. Appl. No. 16/728,101, Taiji Katsura, filed Dec. 27, 2019.
U.S. Appl. No. 16/728,115, Shotaru Nomura, filed Dec. 27, 2019.
U.S. Appl. No. 16/728,122, Masamichi Sato, filed Dec. 27, 2019.
U.S. Appl. No. 16/728,151, Masatake Tanaka, filed Dec. 27, 2019.
U.S. Appl. No. 16/728,171, Takaaki Furui, filed Dec. 27, 2019.
U.S. Appl. No. 16/728,179, Koji Nishikawa, filed Dec. 27, 2019.

*Primary Examiner* — Peter L Vajda
(74) *Attorney, Agent, or Firm* — Venable LLP

(57) ABSTRACT

A toner including a toner particle containing a binder resin, and an external additive, wherein the external additive contains an organosilicon polymer fine particle, the organosilicon polymer has a structure represented by at least one selected from the group consisting of $R^aSiO_{3/2}$ and $R^b{}_2SiO_{2/2}$ (wherein $R^a$ and $R^b$ represent organic groups), and in the number particle size distribution of the toner as measured within a particle size range of from 2 to 60 μm, the number-average particle diameter T-$D_{50n}$ at which the accumulation from the smallest diameter is 50% is from 6 to 12 μm, the number ratio of toner 4 μm or less in size is from 2% to 5% of the total toner, and the number ratio of toner 3 μm or less in size as a percentage of the total toner 4 μm or less in size is from 25% to 50%.

4 Claims, No Drawings

(56) References Cited

U.S. PATENT DOCUMENTS

| | | | | |
|---|---|---|---|---|
| 2004/0137356 | A1 | 7/2004 | Tomita et al. | |
| 2008/0063967 | A1* | 3/2008 | Shin | G03G 9/08764 430/109.3 |
| 2008/0226998 | A1 | 9/2008 | Ishii et al. | |
| 2009/0117477 | A1 | 5/2009 | Magome et al. | |
| 2009/0155706 | A1 | 6/2009 | Shu et al. | |
| 2010/0035171 | A1 | 2/2010 | Watanabe et al. | |
| 2010/0248110 | A1 | 9/2010 | Taguchi et al. | |
| 2014/0220488 | A1 | 8/2014 | Hosoya et al. | |
| 2014/0356779 | A1 | 12/2014 | Hasegawa et al. | |
| 2015/0248072 | A1 | 9/2015 | Katsuta et al. | |
| 2016/0187799 | A1 | 6/2016 | Hiroshi et al. | |
| 2016/0299446 | A1 | 10/2016 | Kuroki et al. | |
| 2017/0219947 | A1 | 8/2017 | Omori et al. | |
| 2017/0329246 | A1 | 11/2017 | Yamawaki et al. | |
| 2018/0329323 | A1 | 11/2018 | Kimura et al. | |
| 2018/0329324 | A1 | 11/2018 | Kamikura et al. | |
| 2018/0329327 | A1 | 11/2018 | Yamawaki et al. | |
| 2018/0329329 | A1 | 11/2018 | Nakamura et al. | |
| 2019/0212667 | A1* | 7/2019 | Chiba | G03G 9/08 |
| 2019/0332024 | A1 | 10/2019 | Umeda et al. | |
| 2020/0026208 | A1 | 1/2020 | Terui et al. | |
| 2020/0026209 | A1 | 1/2020 | Yagi et al. | |
| 2020/0124998 | A1 | 4/2020 | Kototani et al. | |
| 2020/0124999 | A1 | 4/2020 | Tanaka et al. | |

FOREIGN PATENT DOCUMENTS

| | | | | |
|---|---|---|---|---|
| EP | 2 818 932 | | 12/2014 | |
| EP | 2 853 945 | | 4/2015 | |
| EP | 2 860 585 | | 4/2015 | |
| EP | 3 095 805 | | 11/2016 | |
| EP | 3 480 661 | | 5/2019 | |
| EP | 19219784.6 | | 4/2020 | |
| EP | 19219785.3 | | 4/2020 | |
| EP | 19219786.1 | | 4/2020 | |
| EP | 19219787.9 | | 4/2020 | |
| EP | 19219788.7 | | 4/2020 | |
| EP | 19219789.5 | | 4/2020 | |
| EP | 19219790.3 | | 4/2020 | |
| EP | 19219791.1 | | 4/2020 | |
| EP | 19219792.9 | | 4/2020 | |
| JP | 2007-003920 | | 1/2007 | |
| JP | 2018-004804 | | 1/2018 | |
| WO | 2018/003749 | | 1/2018 | |
| WO | WO 2018/003749 | * | 4/2018 | G03G 9/097 |

* cited by examiner

TONER

BACKGROUND OF THE INVENTION

Field of the Invention

The present invention relates to a toner for use in image-forming methods such as electrophotographic methods, electrostatic recording methods and toner jet methods.

Description of the Related Art

Methods such as electrophotographic methods for developing image data through electrostatic latent images are used in copiers, multi-function machines and printers, and recently higher speeds, longer machine lives and smaller machines are in demand. To meet these requirements, there is a need for the development of toners that can ensure high stability without loss of image quality even during long-term use at high speeds with high print percentages. From the standpoint of size reduction, it is also necessary to reduce the volume of each unit as much as possible.

From the standpoint of size reduction, efforts have already been made to save space with various units. In particular, various efforts have been made to improve transferability, because the waste toner container that collects untransferred toner from the photosensitive drum can be made smaller if toner transferability is improved.

In the transfer step, toner on the photosensitive drum is transferred to a medium such as paper, but to detach the toner from the photosensitive drum, it is necessary to reduce the attachment force between the photosensitive drum and the toner. Toners with smaller particle diameters are generally known to have stronger attachment force, and thus the attachment force of the toner as a whole can be reduced and transferability and cleaning performance can be improved by using a toner with a larger particle diameter for example.

However, although transferability can indeed be improved by removing the small-diameter toner particles from the toner by classification, problems arise during long-term use at high speeds and high print percentages. For example, in the cleaning part and developer regulating blade part where the toner is subject to strong shear, cleaning problems and image defects due to melt adhesion to the member may occur during long-term use at high speeds and high print percentages in low-temperature, low-humidity environments where shear force is stronger. Consequently, it has been difficult to simultaneously achieve transferability, cleaning performance, long life and high speeds.

Japanese Patent Application Publication No. 2007-3920 proposes improving transferability, toner particle damage from the cleaning blade, and melt adhesion by the toner to the member by controlling the shape of the toner particle and the content ratio of the release agent.

Japanese Patent Application Publication No. 2018-4804 proposes improving transferability and cleaning performance by covering the toner particle surface with a resin particle to control attachment force.

SUMMARY OF THE INVENTION

Some effects with respect to transferability, cleaning performance and melt adhesion of the toner to the member have been confirmed with this literature. However, there is room for further study in terms of stability in the case of long-term image output at high speeds and high print percentages in low-temperature, low-humidity environments where shear force is stronger.

The present invention provides a toner that resolves these issues. With the provided toner, transferability and cleaning performance are unlikely to decline, and image defects due to melt adhesion to the member and contamination of the member are unlikely to occur even during long-term use in low-temperature, low-humidity environments.

The present invention is a toner having a toner particle containing a binder resin, and an external additive, wherein the external additive contains an organosilicon polymer fine particle, an organosilicon polymer in the organosilicon polymer fine particle has a structure represented by at least one selected from the group consisting of $R^aSiO_{3/2}$ and $R^b{}_2SiO_{2/2}$, wherein $R^a$ and $R^b$ represent organic groups, and in the number particle size distribution of the toner as measured within a particle size range of from 2 μm to 60 μm:

(i) the number-average particle diameter T-$D_{50n}$ at which the accumulation from the smallest diameter is 50% is from 6 μm to 12 μm, (ii) the number ratio of toner 4 μm or less in size is from 2% to 5% of the total toner, and (iii) the number ratio of toner 3 μm or less in size as a percentage of the total toner 4 μm or less in size is from 25% to 50%.

The present invention provides a toner whereby transferability and cleaning performance are unlikely to decline, and image defects due melt adhesion to the member and contamination of the member are unlikely to occur even during long-term use in low-temperature, low-humidity environments.

Further features of the present invention will become apparent from the following description of exemplary embodiments.

DESCRIPTION OF THE EMBODIMENTS

Unless otherwise specified, descriptions of numerical ranges such as "from XX to YY" or "XX to YY" in the present invention include the numbers at the upper and lower limits of the range.

Methods for obtaining high transferability were first considered. In the transfer step, toner on the transfer member is transferred to a medium such as paper, but for the toner to move the transfer member to the medium, it is important to reduce the attachment force between the transfer member and the toner. In general, attachment force is classified as electrostatic attachment force or non-electrostatic attachment force. Focusing on the non-static attachment force of the toner, the inventors studied techniques for improving the transferability of the toner by reducing non-static attachment force, and maintaining high transferability during long-term use.

The inventors considered that to increase transferability, it is important to lower the non-static attachment force of toner groups. Research showed that transferability is excellent if the number-average particle diameter T-$D_{50n}$ at which the accumulation from the smallest diameter is 50% is from 6 μm to 12 μm, and the number ratio of toner 4 μm or less in size is from 2% to 5% of the total toner.

As discussed above, the attachment force is higher the smaller the particle diameter of the toner, so it was thought that the non-static attachment force of the toner groups could be reduced and transfer efficiency could be improved by reducing the amount of toner with small particle diameters in the toner.

Methods for obtaining both cleaning performance and high transferability were considered next.

When cleaning is performed with a blade for example in normal cleaning, the toner remaining on the member is blocked at the blade nip. It has been found that fine toner plays an important role in this process because cleaning occurs when particles are separated by diameter in this nip so that the finer particles are closer to the blade, forming a blocking layer as the toner in the nip is replaced by toner supplied from upstream.

However, as discussed above fine toner is inconvenient for improving transferability due to its strong attachment force. It is therefore difficult to achieve both cleaning performance and high transferability.

The inventors performed research based on the idea that transferability and cleaning performance could be achieved simultaneously by limiting the amount of fine toner contained in the toner to only that capable of forming the blocking layer. As a result, we discovered that transferability and cleaning performance could both be achieved by controlling the number percentage of toner 3 μm or less in size to from 25% to 50% of the total toner 4 μm or less in size, and by adding an organosilicon polymer fine particle to the toner.

We arrived at the present invention after discovering that such a toner has highly stable cleaning performance and transferability and excellent durability even when used for a long time in a low-temperature, low-humidity environment, which is a severe environment for durability and cleaning performance. The inventors believe the organosilicon polymer fine particle plays an important role in achieving these results.

It is thought that because the organosilicon polymer fine particle has elasticity, it can remain on the toner particle surface without becoming embedded in the smaller-diameter toner near the cleaning nip even during long term use. It therefore appears that the organosilicon polymer fine particle does not become embedded over the long term, and can continue to function as a spacer particle between toner particles. The attachment force between toner particles in the nip is reduced as a result, preventing a loss of flowability, so that replacement by fine toner supplied from upstream proceeds smoothly, and it is possible to prevent the toner from being subjected to continuous shear in the nip. It is thought that long-term durability is improved as a result.

Although effects on initial transferability and cleaning performance are obtained even when using a spacer that is a hard fine particle made from a different material from the organosilicon polymer fine particle, these may become embedded in the toner particles when subjected to shear force over a long period of time, so that long-term durability is not improved. Moreover, if the amount of fine toner is merely limited to the amount that allows the blocking layer to be controlled, transferability is obtained, but image problem due to melt adhesion to the member may occur during long-term use. This is thought to be because toner replacement is not promoted, and the same toner is broken down by being subjected to continuous shear.

Preferred requirements for the present invention are described based on the above mechanisms.

First, from the standpoint of transferability, the number-average particle diameter T-$D_{50n}$ at which the accumulation from the smallest diameter is 50% must be from 6 μm to 12 μm in the number particle size distribution of the toner as measured within a particle size range of from 2 μm to 60 μm. Below this range, transferability declines. Above this range, on the other hand, a sufficient amount of small particle diameter toner cannot be secured in the toner, and the number ratio of toner 3 μm or less in size as a percentage of the total toner 4 μm or less in size cannot be achieved.

The T-$D_{50n}$ is preferably from 7 μm to 10 μm. The T-$D_{50n}$ can be controlled for example by adjusting the amount of the flocculant as discussed below in the method for manufacturing the toner particle.

Furthermore, to achieve even greater transferability, the number ratio of toner 4 μm or less in size must be from 2% to 5% of the total toner. Below this range, the blocking layer required for cleaning in the nip does not form properly because the ratio of small-diameter toner particles in the toner is too low, and cleaning performance declines. Above this range, on the other hand, the original goal of high transferability cannot be achieved.

The number ratio of toner 4 μm or less in size is preferably from 3% to 4%. The number ratio of toner 4 μm or less in size can be controlled by classifying the toner particles.

Next, to achieve greater toner durability, the external additive must contain an organosilicon polymer fine particle, and the organosilicon polymer must have a structure represented by at least one selected from the group consisting of $[R^aSiO_{3/2}]$ and $[R^b{}_2SiO_{2/2}]$ (in which $R^a$ and $R^b$ represent organic groups, and preferably each independently represents a $C_{1-6}$ (more preferably $C_{1-3}$, or still more preferably $C_{1-2}$) alkyl group or phenyl group).

If this structure is not included, the additive is hard relative to the toner particle and lacks elasticity. Because the toner receives more shear in the developing and cleaning parts in low-temperature, low-humidity environments, the fine particle gradually becomes embedded in the toner particle, eliminating the buffer effect so that the expected effects are not obtained.

From the standpoint of toner durability, moreover, the number ratio of toner 3 μm or less in size as a percentage of the total toner 4 μm or less in size in the number particle size distribution of the toner must be from 25% to 50%. If the number ratio of toner 3 μm or less in size is below this range, cleaning performance and durability decline because it is impossible to ensure a sufficient quantity so that the small particle diameter toner can be replaced appropriately in the blade nip. If the ratio is above this range, on the other hand, transferability declines because the amount of small particle diameter toner with high attachment force is too large.

The number ratio of toner 3 μm or less in size is preferably from 30% to 40%. The number ratio of toner 3 μm or less in size can be controlled by classifying the toner particles.

From the standpoint of ease of manufacture, the organosilicon polymer fine particle is more preferably a silsesquioxane particle.

The number-average particle diameter P-$D_{50n}$ of the organosilicon polymer fine particle is preferably from 80 nm to 150 nm, or more preferably from 90 nm to 140 nm. If the P-$D_{50n}$ is at least 80 nm, the particle can function as a spacer not only between toner particles but also between the toner and the members, resulting in greater transferability. If it is not more than 150 nm, on the other hand, it is less likely to detach from the toner, and contamination of the members can be controlled. The P-$D_{50n}$ can be controlled by controlling the reaction initiation temperature, the reaction time and the pH during the reaction.

Preferably the toner satisfies formula (A) below, and more preferably formula (A') below:

$$0.04 \leq P_{mass}/T_{3n} \leq 6.00 \quad \text{Formula (A)}$$

$$0.09 \leq P_{mass}/T_{3n} \leq 4.50 \quad \text{Formula (A')}$$

(in which $T_{3n}$ represents the number percentage of toner having particle size of 3 μm or less in size determined cumulatively from the smallest diameter in the number particle size distribution of the toner, and $P_{mass}$ represents the mass parts of the organosilicon polymer fine particle per 100 mass parts of the toner particle in the toner).

If formula (A) is satisfied, an appropriate amount of the organosilicon polymer fine particle is contained in the toner. This means that the effects of the organosilicon polymer fine particle are sufficiently obtained, and also that movement of the organosilicon polymer fine particle to the members is suppressed, which is desirable from the standpoint of toner durability and contamination of the members.

Method for Manufacturing Organosilicon Polymer Fine Particle

The method for manufacturing the organosilicon polymer fine particle is not particularly limited, and for example it can be obtained by dripping a silane compound into water, hydrolyzing it with a catalyst and performing a condensation reaction, after which the resulting suspension is filtered and dried. The particle diameter can be controlled by means of the type and compounding ratio of the catalyst, the reaction initiation temperature, and the dripping time and the like.

Examples of the catalyst include, but are not limited to, acidic catalysts such as hydrochloric acid, hydrofluoric acid, sulfuric acid and nitric acid, and basic catalysts such as ammonia water, sodium hydroxide and potassium hydroxide.

The organosilicon polymer fine particle is preferably a silsesquioxane particle. Preferably the organosilicon polymer fine particle has a structure of alternately binding silicon atoms and oxygen atoms, and some of the silicon atoms form T3 unit structures represented by $R^aSiO_{3/2}$ (in which $R^a$ represents a $C_{1-6}$ (preferably $C_{1-3}$, or more preferably $C_{1-2}$) alkyl group or phenyl group).

Furthermore, in $^{29}$Si-NMR measurement of the organosilicon polymer fine particle, the ratio of the area of peaks derived from silicon having a T3 unit relative to the total area of peaks derived from all silicon element contained in the organosilicon polymer is preferably from 0.90 to 1.00, or more preferably from 0.95 to 1.00.

The organosilicon compound for manufacturing the organosilicon polymer fine particle is explained here.

The organosilicon polymer is preferably a polycondensate of an organosilicon compound having a structure represented by formula (Z) below:

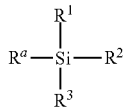

(Z)

(in formula (Z), $R^a$ represents an organic functional group, and each of $R^1$, $R^2$ and $R^3$ independently represents a halogen atom, hydroxyl group or acetoxy group, or a (preferably $C_{1-3}$) alkoxy group).

$R^a$ is an organic functional group without any particular limitations, but preferred examples include $C_{1-6}$ (preferably $C_{1-3}$, more preferably $C_{1-2}$) hydrocarbon groups (preferably alkyl groups) and aryl (preferably phenyl) groups.

Each of $R^1$, $R^2$ and $R^3$ independently represents a halogen atom, hydroxyl group, acetoxy group or alkoxy group. These are reactive groups that form crosslinked structures by hydrolysis, addition polymerization and condensation. Hydrolysis, addition polymerization and condensation of $R^1$, $R^2$ and $R^3$ can be controlled by means of the reaction temperature, reaction time, reaction solvent and pH. An organosilicon compound having three reactive groups ($R^1$, $R^2$ and $R^3$) in the molecule apart from $R^a$ as in formula (Z) is also called a trifunctional silane.

Examples of formula (Z) include the following:

trifunctional methylsilanes such as p-styryl trimethoxysilane, methyl trimethoxysilane, methyl triethoxysilane, methyl diethoxymethoxysilane, methyl ethoxydimethoxysilane, methyl trichlorosilane, methyl methoxydichlorosilane, methyl ethoxydichlorosilane, methyl dimethoxychlorosilane, methyl methoxyethoxychlorosilane, methyl diethoxychlorosilane, methyl triacetoxysilane, methyl diacetoxymethoxysilane, methyl diacetoxyethoxysilane, methyl acetoxydimethoxysilane, methyl acetoxymethoxyethoxysilane, methyl acetoxydiethoxysilane, methyl trihydroxysilane, methyl methoxydihydroxysilane, methyl ethoxydihydroxysilane, methyl dimethoxyhydroxysilane, methyl ethoxymethoxyhydroxysilane and methyl diethoxyhydroxysilane; trifunctional ethylsilanes such as ethyl trimethoxysilane, ethyl triethoxysilane, ethyl trichlorosilane, ethyl triacetoxysilane and ethyl trihydroxysilane; trifunctional propylsilanes such as propyl trimethoxysilane, propyl triethoxysilane, propyl trichlorosilane, propyl triacetoxysilane and propyl trihydroxysilane; trifunctional butylsilanes such as butyl trimethoxysilane, butyl triethoxysilane, butyl trichlorosilane, butyl triacetoxysilane and butyl trihydroxysilane; trifunctional hexylsilanes such as hexyl trimethoxysilane, hexyl triethoxysilane, hexyl trichlorosilane, hexyl triacetoxysilane and hexyl trihydroxysilane; and trifunctional phenylsilanes such as phenyl trimethoxysilane, phenyl triethoxysilane, phenyl trichlorosilane, phenyl triacetoxysilane and phenyl trihydroxysilane. These organosilicon compounds may be used individually, or two or more kinds may be combined.

The following may also be used in combination with the organosilicon compound having the structure represented by formula (Z): organosilicon compounds having four reactive groups in the molecule (tetrafunctional silanes), organosilicon compounds having two reactive groups in the molecule (bifunctional silanes), and organosilicon compounds having one reactive group in the molecule (monofunctional silanes). Examples include:

dimethyl diethoxysilane, tetraethoxysilane, hexamethyl disilazane, 3-aminopropyl trimethoxysilane, 3-aminopropyl triethoxysilane, 3-(2-aminoethyl)aminopropyl trimethoxysilane, 3-(2-aminoethyl)aminopropyl triethoxysilane, and trifunctional vinyl silanes such as vinyl triisocyanatosilane, vinyl trimethoxysilane, vinyl triethoxysilane, vinyl diethoxymethoxysilane, vinyl ethoxydimethoxysilane, vinyl ethoxydihydroxysilane, vinyl dimethoxyhydroxysilane, vinyl ethoxymethoxyhydroxysilane and vinyl diethoxyhydroxysilane.

The content of the structure represented by formula (Z) in the monomers forming the organosilicon polymer is preferably at least 50 mol %, or more preferably at least 60 mol %.

Method for Manufacturing Toner Particle

The toner particle manufacturing method is explained next. The method for manufacturing the toner particle is not particularly limited, and a known method such as a kneading pulverization method or wet manufacturing method may be used. A wet manufacturing method can be used by preference from the standpoint of shape control and obtaining a uniform particle diameter. Examples of wet manufacturing methods include suspension polymerization, dissolution suspension, emulsion polymerization aggregation and emulsion aggregation methods, and an emulsion aggregation method can be used by preference.

In emulsion aggregation methods, a fine particle of a binder resin and a fine particle of another material such as a colorant as necessary are dispersed and mixed in an aqueous medium containing a dispersion stabilizer. A surfactant may also be added to this aqueous medium. A flocculant is then added to aggregate the mixture until the desired toner particle size is reached, and the resin fine particles are also melt adhered together either after or during aggregation. Shape control with heat may also be performed as necessary in this method to form a toner particle.

The fine particle of the binder resin here may be a composite particle formed as a multilayer particle comprising two or more layers composed of different resins. For example, this can be manufactured by an emulsion polymerization method, mini-emulsion polymerization method, phase inversion emulsion method or the like, or by a combination of multiple manufacturing methods.

When the toner particle contains an internal additive, the internal additive may be included in the resin fine particle. A liquid dispersion of an internal additive fine particle consisting only of the internal additive may also be prepared separately, and the internal additive fine particle may then be aggregated together with the resin fine particle when the aggregation. Resin fine particles with different compositions may also be added at different times during aggregation, and aggregated to prepare a toner particle composed of layers with different compositions.

The following may be used as the dispersion stabilizer:

inorganic dispersion stabilizers such as tricalcium phosphate, magnesium phosphate, zinc phosphate, aluminum phosphate, calcium carbonate, magnesium carbonate, calcium hydroxide, magnesium hydroxide, aluminum hydroxide, calcium metasilicate, calcium sulfate, barium sulfate, bentonite, silica and alumina.

Other examples include organic dispersion stabilizers such as polyvinyl alcohol, gelatin, methyl cellulose, methyl hydroxypropyl cellulose, ethyl cellulose, carboxymethyl cellulose sodium salt, and starch.

A known cationic surfactant, anionic surfactant or nonionic surfactant may be used as the surfactant.

Specific examples of cationic surfactants include dodecyl ammonium bromide, dodecyl trimethylammonium bromide, dodecylpyridinium chloride, dodecylpyridinium bromide, hexadecyltrimethyl ammonium bromide and the like.

Specific examples of nonionic surfactants include dodecylpolyoxyethylene ether, hexadecylpolyoxyethylene ether, nonylphenylpolyoxyethylene ether, lauryl polyoxyethylene ether, sorbitan monooleate polyoxyethylene ether, styrylphenyl polyoxyethylene ether, monodecanoyl sucrose and the like.

Specific examples of anionic surfactants include aliphatic soaps such as sodium stearate and sodium laurate, and sodium lauryl sulfate, sodium dodecylbenzene sulfonate, sodium polyoxyethylene (2) lauryl ether sulfate and the like.

Binder Resin

Preferred examples of the binder resin include vinyl resins, polyester resins and the like. Examples of vinyl resins, polyester resins and other binder resins include the following resins and polymers:

monopolymers of styrenes and substituted styrenes, such as polystyrene and polyvinyl toluene; styrene copolymers such as styrene-propylene copolymer, styrene-vinyl toluene copolymer, styrene-vinyl naphthalene copolymer, styrene-methyl acrylate copolymer, styrene-ethyl acrylate copolymer, styrene-butyl acrylate copolymer, styrene-octyl acrylate copolymer, styrene-dimethylaminoethyl acrylate copolymer, styrene-methyl methacrylate copolymer, styrene-ethyl methacrylate copolymer, styrene-butyl methacrylate copolymer, styrene-dimethylaminoethyl methacrylate copolymer, styrene-vinyl methyl ether copolymer, styrene-vinyl ethyl ether copolymer, styrene-vinyl methyl ketone copolymer, styrene-butadiene copolymer, styrene-isoprene copolymer, styrene-maleic acid copolymer and styrene-maleic acid ester copolymer; and polymethyl methacryalte, polybutyl methacrylate, polvinyl acetate, polyethylene, polypropylene, polvinyl butyral, silicone resin, polyamide resin, epoxy resin, polyacrylic resin, rosin, modified rosin, terpene resin, phenol resin, aliphatic or alicyclic hydrocarbon resins and aromatic petroleum resins.

The binder resin preferably contains a vinyl resin, and more preferably contains a styrene copolymer. These binder resins may be used individually or mixed together.

The binder resin preferably contains carboxyl groups, and is preferably a resin manufactured using a polymerizable monomer containing a carboxyl group. Examples include vinylic carboxylic acids such as acrylic acid, methacrylic acid, α-ethylacrylic acid and crotonic acid; unsaturated dicarboxylic acids such as fumaric acid, maleic acid, citraconic acid and itaconic acid; and unsaturated dicarboxylic acid monoester derivatives such as monoacryloyloxyethyl succinate ester, monomethacryloyloxyethyl succinate ester, monoacryloyloxyethyl phthalate ester and monomethacryloyloxyethyl phthalate ester.

Polycondensates of the carboxylic acid components and alcohol components listed below may be used as the polyester resin. Examples of carboxylic acid components include terephthalic acid, isophthalic acid, phthalic acid, fumaric acid, maleic acid, cyclohexanedicarboxylic acid and trimellitic acid. Examples of alcohol components include bisphenol A, hydrogenated bisphenols, bisphenol A ethylene oxide adduct, bisphenol A propylene oxide adduct, glycerin, trimethyloyl propane and pentaerythritol.

The polyester resin may also be a polyester resin containing a urea group. Preferably the terminal and other carboxyl groups of the polyester resins are not capped.

To control the molecular weight of the binder resin constituting the toner particle, a crosslinking agent may also be added during polymerization of the polymerizable monomers.

Examples include ethylene glycol dimethacrylate, ethylene glycol diacrylate, diethylene glycol dimethacrylate, diethylene glycol diacrylate, triethylene glycol dimethacrylate, triethylene glycol diacrylate, neopentyl glycol dimethacrylate, neopentyl glycol diacrylate, divinyl benzene, bis (4-acryloxypolyethoxyphenyl) propane, ethylene glycol diacrylate, 1,3-butylene glycol diacrylate, 1,4-butanediol diacrylate, 1,5-pentanediol diacrylate, 1,6-hexanediol diacrylate, neopentyl glycol diacrylate, diethylene glycol diacrylate, triethylene glycol diacrylate, tetraethylene glycol diacrylate, diacrylates of polyethylene glycol #200, #400 and #600, dipropylene glycol diacrylate, polypropylene glycol diacrylate, polyester diacrylate (MANDA, Nippon Kayaku Co., Ltd.), and these with methacrylate substituted for the acrylate.

The added amount of the crosslinking agent is preferably from 0.001 mass parts to 15.000 mass parts per 100 mass parts of the polymerizable monomers.

Release Agent

The toner may also contain a release agent. In particular, a plasticization effect is easily obtained using an ester wax with a melting point of from 60° C. to 90° C. because the wax is highly compatible with the binder resin.

Examples of ester waxes include waxes consisting primarily of fatty acid esters, such as carnauba wax and montanic acid ester wax; fatty acid esters in which the acid component has been partially or fully deacidified, such as deacidified carnauba wax; hydroxyl group-containing methyl ester compounds obtained by hydrogenation or the like of plant oils and fats; saturated fatty acid monoesters such as stearyl stearate and behenyl behenate; diesterified products of saturated aliphatic dicarboxylic acids and saturated fatty alcohols, such as dibehenyl sebacate, distearyl dodecanedioate and distearyl octadecanedioate; and diesterified products of saturated aliphatic diols and saturated aliphatic monocarboxylic acids, such as nonanediol dibehenate and dodecanediol distearate.

Of these waxes, it is desirable to include a bifunctional ester wax (diester) having two ester bonds in the molecular structure.

A bifunctional ester wax is an ester compound of a dihydric alcohol and an aliphatic monocarboxylic acid, or an ester compound of a divalent carboxylic acid and a fatty monoalcohol.

Specific examples of the aliphatic monocarboxylic acid include myristic acid, palmitic acid, stearic acid, arachidic acid, behenic acid, lignoceric acid, cerotic acid, montanic acid, melissic acid, oleic acid, vaccenic acid, linoleic acid and linolenic acid.

Specific examples of the fatty monoalcohol include myristyl alcohol, cetanol, stearyl alcohol, arachidyl alcohol, behenyl alcohol, tetracosanol, hexacosanol, octacosanol and triacontanol.

Specific examples of the divalent carboxylic acid include butanedioic acid (succinic acid), pentanedioic acid (glutaric acid), hexanedioic acid (adipic acid), heptanedioic acid (pimelic acid), octanedioic acid (suberic acid), nonanedioic acid (azelaic acid), decanedioic acid (sebacic acid), dodecanedioic acid, tridecaendioic acid, tetradecanedioic acid, hexadecanedioic acid, octadecanedioic acid, eicosanedioic acid, phthalic acid, isophthalic acid, terephthalic acid and the like.

Specific examples of the dihydric alcohol include ethylene glycol, propylene glycol, 1,3-propanediol, 1,4-butanediol, 1,5-pentanediol, 1,6-hexanediol, 1,10-decanediol, 1,12-dodecanediol, 1,14-tetradecanediol, 1,16-hexadecanediol, 1,18-octadecanediol, 1,20-eicosanediol, 1,30-triacontanediol, diethylene glycol, dipropylene glycol, 2,2,4-trimethyl-1,3-pentanediol, neopentyl glycol, 1,4-cyclohexane dimethanol, spiroglycol, 1,4-phenylene glycol, bisphenol A, hydrogenated bisphenol A and the like.

Other release agents that can be used include petroleum waxes and their derivatives, such as paraffin wax, microcrystalline wax and petrolatum, montanic wax and its derivatives, hydrocarbon waxes obtained by the Fischer-Tropsch method, and their derivatives, polyolefin waxes such as polyethylene and polypropylene, and their derivatives, natural waxes such as carnauba wax and candelilla wax, and their derivatives, higher fatty alcohols, and fatty acids such as stearic acid and palmitic acid.

The content of the release agent is preferably from 5.0 mass parts to 20.0 mass parts per 100.0 mass parts of the binder resin.

Colorant

A colorant may also be included in the toner. The colorant is not specifically limited, and the following known colorants may be used.

Examples of yellow pigments include yellow iron oxide, Naples yellow, naphthol yellow S, Hansa yellow G, Hansa yellow 10G, benzidine yellow G, benzidine yellow GR, quinoline yellow lake, permanent yellow NCG, condensed azo compounds such as tartrazine lake, isoindolinone compounds, anthraquinone compounds, azo metal complexes, methine compounds and allylamide compounds. Specific examples include:

C.I. pigment yellow 12, 13, 14, 15, 17, 62, 74, 83, 93, 94, 95, 109, 110, 111, 128, 129, 147, 155, 168 and 180.

Examples of red pigments include red iron oxide, permanent red 4R, lithol red, pyrazolone red, watching red calcium salt, lake red C, lake red D, brilliant carmine 6B, brilliant carmine 3B, eosin lake, rhodamine lake B, condensed azo compounds such as alizarin lake, diketopyrrolopyrrole compounds, anthraquinone compounds, quinacridone compounds, basic dye lake compounds, naphthol compounds, benzimidazolone compounds, thioindigo compound and perylene compounds. Specific examples include:

C.I. pigment red 2, 3, 5, 6, 7, 23, 48:2, 48:3, 48:4, 57:1, 81:1, 122, 144, 146, 166, 169, 177, 184, 185, 202, 206, 220, 221 and 254.

Examples of blue pigments include alkali blue lake, Victoria blue lake, phthalocyanine blue, metal-free phthalocyanine blue, phthalocyanine blue partial chloride, fast sky blue, copper phthalocyanine compounds such as indathrene blue BG and derivatives thereof, anthraquinone compounds and basic dye lake compounds. Specific examples include:

C.I. pigment blue 1, 7, 15, 15:1, 15:2, 15:3, 15:4, 60, 62 and 66.

Examples of black pigments include carbon black and aniline black. These colorants may be used individually, or as a mixture, or in a solid solution.

The content of the colorant is preferably from 3.0 mass parts to 15.0 mass parts per 100.0 mass parts of the binder resin.

Charge Control Agent

The toner particle may also contain a charge control agent. A known charge control agent may be used. A charge control agent that provides a rapid charging speed and can stably maintain a uniform charge quantity is especially desirable.

Examples of charge control agents for controlling the negative charge properties of the toner particle include:

organic metal compounds and chelate compounds, including monoazo metal compounds, acetylacetone metal compounds, aromatic oxycarboxylic acids, aromatic dicarboxylic acids, and metal compounds of oxycarboxylic acids and dicarboxylic acids. Other examples include aromatic oxycarboxylic acids, aromatic mono- and polycarboxylic acids and their metal salts, anhydrides and esters, and phenol derivatives such as bisphenols and the like. Further examples include urea derivatives, metal-containing salicylic acid compounds, metal-containing naphthoic acid compounds, boron compounds, quaternary ammonium salts and calixarenes.

Meanwhile, examples of charge control agents for controlling the positive charge properties of the toner particle include nigrosin and nigrosin modified with fatty acid metal salts; guanidine compounds; imidazole compounds; quaternary ammonium salts such as tributylbenzylammonium-1-hydroxy-4-naphthosulfonate salt and tetrabutylammonium tetrafluoroborate, onium salts such as phosphonium salts that are analogs of these, and lake pigments of these; triphenylmethane dyes and lake pigments thereof (using phosphotungstic acid, phosphomolybdic acid, phosphotungstenmolybdic acid, tannic acid, lauric acid, gallic acid, ferricyanic acid or a ferrocyan compound or the like as the laking agent); metal salts of higher fatty acids; and resin charge control agents.

One of these charge control agents alone or a combination of two or more may be used. The content of these charge control agents is preferably from 0.01 mass parts to 10.00 mass parts per 100.00 mass parts of the binder resin.

The methods for measuring the various physical properties in the present invention are explained below.

Identifying Organosilicon Polymer Fine Particle (Measuring Ratio of T3 Unit Structures)

The compositions and proportions of the constituent compounds of the organosilicon polymer fine particle in the toner are identified by solid pyrolysis gas chromatography/mass spectrometry (hereunder solid pyrolysis GC/MS) and NMR.

When the toner contains a silica fine particle in addition to the organosilicon polymer fine particle, 1 g of the toner is dissolved and dispersed in 31 g of chloroform in a vial. Dispersion is performed for 30 minutes with an ultrasound homogenizer to prepare a liquid dispersion.

Ultrasonic processing unit: VP-050 ultrasound homogenizer (Taitec Corporation)

Microchip: Step microchip, tip diameter $_{\varphi}$2 mm

Microchip tip position: Center of glass vial and 5 mm above bottom of vial

Ultrasound conditions: Intensity 30%, 30 minutes; ultrasound is applied while cooling the vial with ice water so that the temperature of the dispersion does not rise.

The dispersion is transferred to a glass tube for a swing rotor (50 mL), and centrifuged for 30 minutes at 58.33 $S^{-1}$ with a centrifuge (H-9R; Kokusan Co., Ltd.). After centrifugation, the Si content apart from the organosilicon polymer is contained in the lower layer in the glass tube. The chloroform solution of the upper layer containing the Si content derived from the organosilicon polymer is collected, and the chloroform is removed by vacuum drying (40° C./24 hours) to prepare a sample.

Using this sample or the organosilicon polymer fine particle, the abundance ratios of the constituent compounds of the organosilicon polymer fine particle and the ratio of T3 unit structures in the organosilicon polymer fine particle are measured and calculated by solid $^{29}$Si-NMR.

The types of the constituent compounds of the organosilicon polymer fine particle are analyzed by solid pyrolysis GC/MS.

The organosilicon polymer fine particle is pyrolyzed at 550° C. to 700° C., the decomposition product derived from the organosilicon polymer fine particle is measured by mass spectrometry, and the degradation peaks can then be analyzed to identify the types of constituent compounds in the organosilicon polymer fine particle.

Pyrolysis GC/MS Measurement Conditions

Pyrolyzer: JPS-700 (Japan Analytical Industry Co., Ltd.)

Pyrolysis temperature: 590° C.

GC/MS unit: Focus GC/ISQ (Thermo Fisher Scientific)

Column: HP-5MS, length 60 m, bore 0.25 mm, film thickness 0.25 μm

Injection port temperature: 200° C.

Flow pressure: 100 kPa

Split: 50 mL/min

MS ionization: EI

Ion source temperature: 200° C., mass range 45 to 650

The abundance ratios of the identified constituent compounds of the organosilicon polymer fine particle are then measured and calculated by solid $^{29}$Si-NMR. In solid $^{29}$Si-NMR, peaks are detected in different shift regions according to the structures of functional groups binding to the Si of the constituent compounds of the organosilicon polymer fine particle. Each peak position can be specified with a standard sample to specify the structure binding to the Si. The abundance ratio of each constituent compound can then be calculated from the resulting peak area. The proportion of peak areas with T3 unit structures relative to all peak areas can then be determined by calculation. The measurement conditions for solid $^{29}$Si-NMR are as follows for example.

Unit: JNM-ECX5002 (JEOL RESONANCE Inc.)

Temperature: Room temperature

Measurement method: DDMAS method, $^{29}$Si 45°

Sample tube: Zirconia 3.2 mm $_{\varphi}$

Sample: Packed in sample tube in powder form

Sample rotation: 10 kHz

Relaxation delay: 180 s

Scan: 2000

After this measurement, the peaks of the multiple silane components having different substituents and linking groups in the organosilicon polymer are separated by curve fitting into the following X1, X2, X3 and X4 structures, and the respective peak areas are calculated.

Note that the X3 structure mentioned below corresponds to the T3 unit structure in the present invention.

X1 structure: $(Ri)(Rj)(Rk)SiO_{1/2}$ (A1)

X2 structure: $(Rg)(Rh)Si(O_{1/2})_2$ (A2)

X3 structure: $RmSi(O_{1/2})_3$ (A3)

X4 structure: $Si(O_{1/2})_4$ (A4)

X1

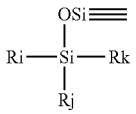

(A1)

X2

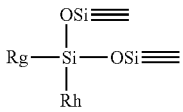

(A2)

X3

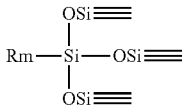

(A3)

-continued

X4

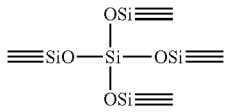

(A4)

The organic group represented by $R^a$ above is confirmed by $^{13}$C-NMR.

$^{13}$C-NMR (Solid) Measurement Conditions

Unit: JNM-ECX500II (JEOL RESONANCE Inc.)

Sample tube: 3.2 mm $_{\varphi}$

Sample: Packed in sample tube in powder form

Sample temperature: Room temperature

Pulse mode: CP/MAS

Measurement nuclear frequency: 123.25 MHz ($^{13}$C)

Standard substance: Adamantane (external standard: 29.5 ppm)

Sample rotation: 20 kHz

Contact time:2 ms

Delay time: 2 s

Number of integrations: 1024

In this method, the hydrocarbon group represented by $R^a$ above is confirmed based on the presence or absence of signals attributable to methyl groups (Si—$CH_3$), ethyl groups (Si—$C_2H_5$), propyl groups (Si—$C_3H_7$), butyl groups (Si—$C_4H_9$), pentyl groups (Si—$C_5H_{11}$), hexyl groups (Si—$C_6H_{13}$) or phenyl groups (Si—$C_6H_5$—) bound to silicon atoms.

Measuring Organosilicon polymer Fine Particle in Toner

The content of organosilicon polymer fine particle in toner can be determined by the following method.

When a silicon-containing substance other than the organosilicon polymer fine particle is included in the toner, 1 g of toner is dissolved in 31 g of chloroform in a vial, and silicon-containing matter is dispersed away from the toner particle. Dispersion is performed for 30 minutes with an ultrasonic homogenizer to prepare a liquid dispersion.

Ultrasonic processing unit: VP-050 ultrasound homogenizer (Taitec Corporation)

Microchip: Step microchip, tip diameter $_{100}$ 2 mm

Microchip tip position: Center of glass vial and 5 mm above bottom of vial

Ultrasound conditions: Intensity 30%, 30 minutes; ultrasound is applied while cooling the vial with ice water so that the temperature of the dispersion does not rise.

The dispersion is transferred to a swing rotor glass tube (50 mL), and centrifuged for 30 minutes under conditions of 58.33 $S^{-1}$ with a centrifuge (H-9R; Kokusan Co., Ltd.). After centrifugation, silica-containing material other than the organosilicon polymer fine particle is contained in the lower layer in the glass tube. The chloroform solution of the upper layer is collected, and the chloroform is removed by vacuum drying (40° C./24 hours).

This step is repeated to obtain 4 g of a dried sample. This is pelletized, and the silicon content is determined by fluorescence X-ray.

Fluorescence X-ray is performed in accordance with JIS K 0119-1969. Specifically, this is done as follows.

An "Axios" wavelength disperser fluorescence X-ray spectrometer (PANalytical) is used as the measurement unit with the accessory "SuperQ ver. 5.0 L" dedicated software (PANalytical) for setting the measurement conditions and analyzing the measurement data. Rh is used for the anode of the X-ray tube and vacuum as the measurement atmosphere, and the measurement diameter (collimator mask diameter) is 27 mm.

Measurement is performed by the Omnian method in the range of elements F to U, and detection is performed with a proportional counter (PC) for light elements and a scintillation counter (SC) for heavy elements. The acceleration voltage and current value of the X-ray generator are set so as to obtain an output of 2.4 kW. For the measurement sample, 4 g of sample is placed in a dedicated aluminum pressing ring and smoothed flat, and then pressed for 60 seconds at 20 MPa with a "BRE-32" tablet compression molding machine (Maekawa Testing Machine Mfg. Co., Ltd.) to mold a pellet 2 mm thick and 39 mm in diameter.

Measurement is performed under the above conditions to identify each element based on its peak position in the resulting X-ray, and the mass ratio of each element is calculated from the count rate (unit: cps), which is the number of X-ray photons per unit time.

For the analysis, the mass ratios of all elements contained in the sample are calculated by the FP assay method, and the content of silicon in the toner is determined. In the FP assay method, the balance is set according to the binder resin of the toner.

The content of the organosilicon polymer fine particle in the toner can be calculated from the silicon content of the toner as determined by fluorescence X-ray and the content ratio of silicon in the constituent compounds.

Number-average Particle Diameter P-$D_{50n}$ of Organosilicon Polymer Fine Particle The number-average particle diameter P-$D_{50n}$ of the organosilicon polymer fine particle is measured with a scanning electron microscope (trade name: "S-4800", Hitachi, Ltd.). The toner having the organosilicon polymer fine particle as an external additive is observed, and the long diameters of 100 randomly-selected primary particles of the organosilicon polymer fine particle are measured in a field with a maximum magnification of 50,000×, and used to determine the number-average particle diameter P-$D_{50n}$. The observation magnification is adjusted appropriately according to the size of the organosilicon polymer fine particle.

The organosilicon polymer fine particle contained in the toner can be identified by a combination of shape observation by SEM and elemental analysis by EDS.

The toner is observed in a field enlarged to a maximum magnification of 50,000× with a scanning electron microscope (trade name: "S-4800", Hitachi, Ltd.). The microscope is focused on the toner particle surface, and the external additive is observed. Each particle of the external additive is subjected to EDS analysis to determine whether or not the analyzed particle is an organosilicon polymer fine particle based on the presence or absence of an Si element peak.

When the toner contains both an organosilicon polymer fine particle and a silica fine particle, the ratio of the elemental contents (atomic %) of Si and O (Si/O ratio) is compared with that of a standard product to identify the organosilicon polymer fine particle. Standard products of both the organosilicon polymer fine particle and silica fine particle are subjected to EDS analysis under the same conditions, to determine the respective elemental contents (atomic %) of Si and O in both. The Si/O ratio of the organosilicon polymer fine particle is given as A, and the Si/O ratio of the silica fine particle as B. Measurement conditions are selected such that A is significantly larger than B. Specifically, the standard products are measured 10 times under the same conditions, and arithmetic means are obtained for both A and B. The measurement conditions are selected so that the resulting average values yield an A/B ratio greater than 1.1.

If the Si/O ratio of particle to be distinguished is closer to A than to [(A+B)/2], the fine particle is judged to be an organosilicon polymer fine particle.

Tospearl 120A (Momentive Performance Materials Japan LLC) is used as the standard product for the organosilicon polymer fine particle, and HDK V15 (Asahi Kasei Corporation) as the standard product for the silica fine particle.

Measuring Particle Diameter of Toner Particle and Number Ratio of Small Particle Diameter Toner A "Multisizer (R) 3 Coulter Counter" precise particle size distribution analyzer (Beckman Coulter, Inc.) based on the pore electrical resistance method is used together with the dedicated "Beckman Coulter Multisizer 3 Version 3.51" software (Beckman Coulter, Inc.). Using an aperture diameter of 100 μm, measurement is performed with 25,000 effective measurement channels, and the measurement data are analyzed to calculate the particle diameter. The aqueous electrolytic solution used in measurement may be a solution of special grade sodium chloride dissolved in ion-exchange water to a concentration of about 1 mass %, such as "ISOTON II" (Beckman Coulter, Inc.), for example. The following settings are performed on the dedicated software prior to measurement and analysis.

On the "Change standard measurement method (SOM)" screen of the dedicated software, the total count number in control mode is set to 50000 particles, the number of measurements to 1, and the Kd value to a value obtained with "Standard particles 10.0 μm" (Beckman Coulter, Inc.). The threshold and noise level are set automatically by pushing the threshold/noise level measurement button. The current is set to 1600 μA, the gain to 2, and the electrolyte solution to ISOTON II, and a check is entered for aperture tube flush after measurement.

On the "Conversion settings from pulse to particle diameter" screen of the dedicated software, the bin interval is set to the logarithmic particle diameter, the particle diameter bins to 256, and the particle diameter range to from 2 μm to 60 μm.

The specific measurement methods are as follows.

(1) About 200 mL of the aqueous electrolytic solution is added to a dedicated 250 mL glass round-bottomed beaker of the Multisizer 3, the beaker is set on the sample stand, and stirring is performed with a stirrer rod counter-clockwise at a rate of 24 rps. Contamination and bubbles in the aperture tube are then removed by the "Aperture tube flush" function of the dedicated software.

(2) 30 mL of the same aqueous electrolytic solution is placed in a 100 mL glass flat-bottomed beaker, and about 0.3 mL of a dilution of "Contaminon N" (a 10% by mass aqueous solution of a neutral detergent for washing precision instruments, Wako Pure Chemical Industries, Ltd.) diluted 3-fold by mass with ion-exchange water is added.

(3) A predetermined amount of ion-exchange water and about 2 mL of Contaminon N are added to the water tank of an ultrasonic disperser "Ultrasonic Dispersion System Tetra150" (Nikkaki Bios Co., Ltd.) with an electrical output of 120 W equipped with two built-in oscillators having an oscillating frequency of 50 kHz with their phases shifted by 180° from each other.

(4) The beaker of (2) above is set in the beaker-fixing hole of the ultrasonic disperser, and the ultrasonic disperser is operated. The height position of the beaker is adjusted so as to maximize the resonant condition of the liquid surface of the aqueous electrolytic solution in the beaker.

(5) The aqueous electrolytic solution in the beaker of (4) above is exposed to ultrasound as about 10 mg of toner (particles) is added bit by bit to the aqueous electrolytic solution, and dispersed. Ultrasound dispersion is then continued for a further 60 seconds. During ultrasound dispersion, the water temperature in the tank is adjusted appropriately to from 10° C. to 40° C.

(6) The aqueous electrolytic solution of (5) above with the toner (particles) dispersed therein is dripped with a pipette into the round-bottomed beaker of (1) above set on the sample stand, and adjusted to a measurement concentration of about 5%. Measurement is then performed until the number of measured particles reaches 50000.

(7) The measurement data is analyzed with the dedicated software included with the apparatus, and the weight-average particle diameter (D4) is calculated. The weight-average particle diameter (D4) is the "Average diameter" on the analysis/volume statistical value (arithmetic mean) screen when graph/volume % is set in the dedicated software. When graph/number % is set in the dedicated software, the "50% D diameter" on the "Analysis/number statistic value" screen is the number-average particle diameter ($T\text{-}D_{50n}$).

(8) Based on the measurement data, the ratio of toner 4 μm or less in size and the number ratio of toner 3 μm or less in size relative to the total toner 4 μm or less in size can be calculated with any spreadsheet software.

Specifically, the number percentage of toner 4 μm or less in size is calculated by dividing the number of toner particles with a particle diameter of not more than 4 μm in the measured toner by the total number of toner particles. The number ratio of toner 3 μm or less in size relative to the total toner 4 μm or less in size is calculated by dividing the number of toner particles with a particle diameter of not more than 3 μm in the measured toner by the number of toner particles with a particle diameter of not more than 4 μm in the measured toner.

A spreadsheet software such as the Excel 2016 (Microsoft Corporation software of Microsoft Office Professional Plus 2016 can be used.

EXAMPLES

The invention is explained in more detail below based on examples and comparative examples, but the invention is in no way limited to these. Unless otherwise specified, parts in the examples are based on mass.

Manufacturing examples of the organosilicon polymer fine particle are explained first.

Manufacturing Example of Organosilicon Polymer Fine Particle 1

Step 1

360 parts of water were placed in a reactor equipped with a thermometer and a stirrer, and 15 parts of 5.0 mass % hydrochloric acid were added to obtain a uniform solution. This was stirred at 25° C. as 136 parts of methyl trimethoxysilane were added, and the mixture was stirred for 5 hours and then filtered to obtain a clear reaction solution containing a silanol compound or a partial condensate thereof.

Step 2

540 parts of water were placed in a reactor equipped with a thermometer, a stirrer and a dripping mechanism, and 17 parts of 10.0 mass % ammonia water were added to obtain a uniform solution. This was stirred at 35° C. as 100 parts of the reaction solution obtained in Step 1 were dripped in over the course of 0.5 hours, and then stirred for 6 hours to obtain a suspension. The resulting suspension was centrifuged to precipitate and remove fine particles, and then dried for 24 hours in a drier at 200° C. to obtain an organosilicon polymer fine particle 1.

The number-average particle diameter of the primary particles of the resulting organosilicon polymer fine particle 1 measured by scanning electron microscope was 100 nm.

Manufacturing Examples of Organosilicon Polymer Fine Particles 2 to 6

Organosilicon polymer fine particles 2 to 6 were obtained as in the manufacturing example of the organosilicon polymer fine particle 1 except that the silane compound, reaction initiation temperature, added amount of the catalyst, and dripping time were changed as shown in Table 1. The physical properties are shown in Table 1.

mixed and dissolved. An aqueous solution of 1.5 parts of Neogen RK (DKS Co., Ltd.) in 150 parts of ion-exchange water was added and dispersed. This was then gently stirred for 10 minutes as an aqueous solution of 0.3 parts of potassium persfulate in 10 parts of ion-exchange water was added. After nitrogen purging, emulsion polymerization was performed for 6 hours at 70° C. After completion of polymerization, the reaction solution was cooled to room temperature, and ion-exchange water was added to obtain a resin particle dispersion with a median volume-based particle diameter of 0.2 μm and a solids concentration of 12.5 mass %.

Preparing Release Agent Dispersion 100 parts of a release agent (behenyl behenate, melting point 72.1° C.) and 15 parts of Neogen RK were mixed with 385 parts of ion-exchange water, and dispersed for about 1 hour with a wet type jet mill unit JN100 (Jokoh Co., Ltd.) to obtain a release agent dispersion. The solids concentration of the release agent dispersion was 20 mass %.

Preparation of Colorant Dispersion 100 parts of carbon black "Nipex35 (Orion Engineered Carbons)" as a colorant and 15 parts of Neogen RK were mixed with 885 parts of ion-exchange water, and dispersed for about 1 hour in a wet type jet mill unit JN100 to obtain a colorant dispersion.

TABLE 1

| | Step 1 | | | | | | |
|---|---|---|---|---|---|---|---|
| Fine particle | Water | Hydrochloric acid | Reaction temperature | Silane compound A | | Silane compound B | |
| No. | Parts | Parts | ° C. | Name | Parts | Name | Parts |
| 1 | 360 | 15 | 25 | Methyl trimethoxysilane | 136 | | |
| 2 | 360 | 15 | 25 | Methyl trimethoxysilane | 122.4 | Dimethyl dimethoxysilane | 16.4 |
| 3 | 360 | 13.4 | 25 | Methyl trimethoxysilane | 136 | | |
| 4 | 360 | 14.2 | 25 | Methyl trimethoxysilane | 136 | | |
| 5 | 360 | 17 | 25 | Methyl trimethoxysilane | 136 | | |
| 6 | 360 | 18.5 | 25 | Methyl trimethoxysilane | 136 | | |

| | Step 2 | | | | | | |
|---|---|---|---|---|---|---|---|
| Fine particle No. | Reaction solution obtained in Step 1 Parts | Water Parts | Ammonia water Parts | Reaction initiation temperature ° C. | Dripping time h | $P\text{-}D_{50n}$ nm | Peak area ratio of T3 unit structures |
| 1 | 100 | 540 | 17 | 35 | 0.5 | 100 | 1.00 |
| 2 | 100 | 540 | 17 | 35 | 0.5 | 100 | 0.95 |
| 3 | 100 | 540 | 15.4 | 39 | 0.9 | 60 | 1.00 |
| 4 | 100 | 540 | 16.2 | 37 | 0.7 | 80 | 1.00 |
| 5 | 100 | 540 | 19 | 30 | 0.33 | 150 | 1.00 |
| 6 | 100 | 540 | 20 | 30 | 0.29 | 200 | 1.00 |

Toner Particle Manufacturing Examples

Toner particle manufacturing examples are explained here.

Toner Particle 1

Preparing Binder Resin Particle Dispersion 89.5 parts of styrene, 9.2 parts of butyl acrylate, 1.3 parts of acrylic acid and 3.2 parts of n-lauryl mercaptane were 265 parts of the resin particle dispersion, 10 parts of the release agent dispersion and 10 parts of the colorant dispersion were dispersed with a homogenizer (IKA Japan K.K., Ultra-Turrax T50) to obtain a dispersion (1). The temperature inside the vessel was adjusted to 30° C. under stirring, and 1 mol/L sodium hydroxide aqueous solution was added to adjust the pH to 8.0. An aqueous solution of 0.3 parts of magnesium sulfate dissolved in 10 parts of ion-exchange water was added at 30° C. under stirring over the course of 10 minutes as a flocculant.

This was left for 3 minutes before initiating temperature rise, and the temperature was raised to 50° C. to produce conjoined particles. The particle diameter of the conjoined particles was measured under these conditions with a "Multisizer 3 Coulter Counter" (registered trademark, Beckman Coulter, Inc.). Once the number-average particle diameter reached 7 μm, 3.0 parts of sodium chloride and 8.0 parts of Neogen RK were added to arrest particle growth.

The temperature was then raised to 95° C. to fuse and spheroidize the conjoined particles. Temperature lowering was initiated when the average circularity reached 0.980, and the temperature was lowered to 30° C. to obtain a toner particle dispersion 1.

Hydrochloric acid was added to adjust the pH of the resulting toner particle dispersion 1 to 1.5 or less, and the dispersion was stirred for 1 hour, left standing, and then subjected to solid-liquid separation in a pressure filter to obtain a toner cake. This was made into a slurry with ion-exchange water, re-dispersed, and subjected to solid-liquid separation in the previous filter unit. Re-slurrying and solid-liquid separation were repeated until the electrical conductivity of the filtrate was not more than 5.0 μS/cm to complete final solid-liquid separation and obtain a toner cake.

The resulting toner cake was dried with a flash jet dryer (air dryer) (Seishin Enterprise Co., Ltd.) to obtain a toner particle 1. The drying conditions were a blowing temperature of 90° C. and a dryer outlet temperature of 40° C., with the toner cake supply speed adjusted according to the moisture content of the toner cake so that the outlet temperature did not deviate from 40° C.

Toner Particle 2

A toner particle 2 was obtained in the same way as the toner particle 1 except that the particle growth was arrested when the number-average particle diameter reached 12 μm when producing the conjoined particles.

Toner Particle 3

A toner particle 3 was obtained in the same way as the toner particle 1 except that the particle growth was arrested when the number-average particle diameter reached 6 μm when producing the conjoined particles.

Toner Particle 4

A toner particle 4 was obtained in the same way as the toner particle 1 except that the particle growth was arrested when the number-average particle diameter reached 5 μm when producing the conjoined particles.

Toner Particle 5

A toner particle 5 was obtained in the same way as the toner particle 1 except that the particle growth was arrested when the number-average particle diameter reached 13 μm when producing the conjoined particles.

A manufacturing example of a classified toner is explained next.

Classified Toner 1

Fine and coarse powder were cut from the toner particle 1 obtained by the above methods by adjusting the blowing injection pressure, blowing air volume and edge using a multi-division classifier using the Coanda effect, to obtain a classified toner 1. When the particle diameter and number ratio of small particle diameter toner in the resulting particles were measured, the number-average particle diameter $T\text{-}D_{50n}$ was 7 μm, and number ratio of toner 4 μm or less in size was 3%, and the number ratio of toner 3 μm or less in size relative to all toner 4 μm or less in size was 37%.

Classified Toners 2 to 14

Classified toners 2 to 14 were obtained in the same way as the classified toner 1 except that the toner particle and classification conditions (specifically, the blowing injection pressure, blowing air volume and edge adjustment) were changed. The physical properties of the resulting classified toners are shown in Table 2.

TABLE 2

| Toner No. | Toner particle No. | Classified toner No. | $T\text{-}D_{50n}$ μm | number ratio of toner 4 μm or less in size % | X % | Organosilicon polymer fine particle No. | Organosilicon polymer fine particle Parts | $P_{mass}/T_{3n}$ |
|---|---|---|---|---|---|---|---|---|
| 1 | 1 | 1 | 7 | 3 | 37 | Fine particle 1 | 1.0 | 0.90 |
| 2 | 2 | 2 | 12 | 3 | 25 | Fine particle 1 | 1.0 | 1.33 |
| 3 | 3 | 3 | 6 | 3 | 50 | Fine particle 1 | 1.0 | 0.67 |
| 4 | 1 | 4 | 7 | 2 | 45 | Fine particle 1 | 1.0 | 1.11 |
| 5 | 1 | 5 | 7 | 5 | 30 | Fine particle 1 | 1.0 | 0.67 |
| 6 | 1 | 1 | 7 | 3 | 37 | Fine particle 2 | 1.0 | 0.90 |
| 7 | 1 | 1 | 7 | 3 | 37 | Fine particle 3 | 1.0 | 0.90 |
| 8 | 1 | 1 | 7 | 3 | 37 | Fine particle 4 | 1.0 | 0.90 |
| 9 | 1 | 1 | 7 | 3 | 37 | Fine particle 5 | 1.0 | 0.90 |
| 10 | 1 | 1 | 7 | 3 | 37 | Fine particle 6 | 1.0 | 0.90 |
| 11 | 1 | 6 | 7 | 5 | 48 | Fine particle 1 | 0.1 | 0.04 |
| 12 | 1 | 7 | 7 | 5 | 44 | Fine particle 1 | 0.1 | 0.05 |
| 13 | 1 | 8 | 7 | 2 | 35 | Fine particle 1 | 4.2 | 6.00 |
| 14 | 1 | 8 | 7 | 2 | 35 | Fine particle 1 | 4.5 | 6.43 |
| C. 1 | 1 | 1 | 7 | 3 | 37 | Silica | — | — |
| C. 2 | 4 | 9 | 5 | 5 | 52 | Fine particle 1 | 1.0 | 0.38 |
| C. 3 | 5 | 10 | 13 | 2 | 23 | Fine particle 1 | 1.0 | 2.22 |
| C. 4 | 1 | 11 | 7 | 1 | 36 | Fine particle 1 | 1.0 | 2.00 |

TABLE 2-continued

| Toner No. | Toner particle No. | Classified toner No. | T-$D_{50n}$ μm | number ratio of toner 4 μm or less in size % | X % | Organosilicon polymer fine particle No. | Parts | $P_{mass}/T_{3n}$ |
|---|---|---|---|---|---|---|---|---|
| C. 5 | 1 | 12 | 7 | 6 | 36 | Fine particle 1 | 1.0 | 0.50 |
| C. 6 | 1 | 13 | 7 | 4 | 24 | Fine particle 1 | 1.0 | 1.11 |
| C. 7 | 1 | 14 | 7 | 2 | 52 | Fine particle 1 | 1.0 | 0.95 |

In the Table, "C." denotes "Comparative", and "X" denotes "the number ratio of toner 3 μm or less in size relative to all toner 4 μm or less in size".

The toner manufacturing examples are explained below.

Manufacturing Example of Toner 1

100 parts of the classified toner 1 obtained by the above method and 1.0 parts of the organosilicon polymer fine particle 1 were placed in an FM mixer (Nippon Coke & Engineering Co., Ltd., FM10C) with 7° C. water in the jacket. Once the water temperature in the jacket had stabilized at 7° C.±1° C., this was mixed for 5 minutes at a 38 m/sec peripheral speed of the rotating blade, to obtain a toner mixture 1. The amount of water passing through the jacket was adjusted appropriately during this process so that the temperature inside the FM mixer tank did not exceed 25° C.

The resulting toner mixture 1 was sieved with a 75 μm mesh sieve to obtain a toner 1.

Manufacturing Examples of Toners 2 to 14 and Comparative Toners 1 to 7

Toners 2 to 14 and comparative toners 1 to 7 were obtained as in the manufacturing example of the toner 1 except that the classified toner and the type and added parts of the organosilicon polymer fine particle were changed as shown in Table 2. The physical properties are shown in Table 2.

In comparative toner 1, 1.0 part of X-24-9163A (Shin-Etsu Chemical Co., Ltd.) was used as the silica.

Example 1

Using a laser beam printer LBP652C (Canon Inc.), the process speed was modified to 400 mm/s considering the even higher speeds and longer lives of future printers, an LBP652C cartridge was filled with the toner 1, and the following evaluations were performed. A4 color laser copy paper (Canon Inc., 80 g/$m^2$) was used as the evaluation paper.

The evaluation results are shown in Table 3.

Evaluation of Cleaning Performance

Cleaning performance was evaluated at a low print percentage (1%). Under these conditions, the amount of small particle diameter toner supplied to the cleaning nip is less, so this is a severe evaluation for cleaning performance. Because ability to follow the photosensitive drum declines when the cleaning blade becomes harder, the evaluation was performed in a low-temperature, low-humidity environment (15° C./15% RH). A rank of A or B is considered passing.

Evaluation Standard

A: No cleaning defects on paper even after 15,000 sheets of continuous output.

B: Within a range of more than 10,000 to less than 15,000 sheets of continuous output, vertical streaks on the paper occurred due to slippage of toner around the cleaning blade.

C: Within a range of more than 5,000 to 10,000 or less sheets of continuous output, vertical streaks on the paper occurred due to slippage of toner around the cleaning blade.

D: Within a range of 0 to 5,000 sheets of continuous output, vertical streaks on the paper occurred due to slippage of toner around the cleaning blade.

Evaluation of Transfer Efficiency

Transfer efficiency is a measure of transferability that shows what percentage of the toner developed on the photosensitive drum is transferred to the intermediate transfer belt. Transfer efficiency was evaluated by forming a solid image continuously on a recording medium. After 3,000 sheets of the solid image were formed, the toner transferred to the intermediate transfer belt and the residual toner remaining on the photosensitive drum after transfer were peeled off with polyester adhesive tape.

The peeled adhesive tape was affixed to paper, and the density when only adhesive tape was affixed to paper was subtracted from the resulting toner density to calculated the density differences for both. The transfer efficiency is the ratio of the toner density difference on the intermediate transfer belt given 100 as the sum of both toner density differences, and transfer efficiency is better the greater this percentage. Measurement was performed in a low-temperature, low-humidity environment (15° C./15% RH), and transfer efficiency after formation of the 3,000 images above was evaluated based on the following standard. A rank of A, B or C is considered passing.

The toner density was measured with an X-Rite color reflection densitometer (500 series).

Evaluation Standard

A: Transfer efficiency at least 98%

B: Transfer efficiency from 95% to less than 98%

C: Transfer efficiency from 90% to less than 95%

D: Transfer efficiency less than 90%

Evaluation of Image Problems Due to Melt Adhesion to Member and Contamination of Member A 100,000-sheet image output test was performed by printing a horizontal line pattern with a print percentage of 1%, 2 sheets per job, with the mode set so that the machine was stopped temporarily between job and job before starting the next job.

Image problems due to melt adhesion to the member and contamination of the member were confirmed after output of 50,000 sheets and 100,000 sheets. The evaluation was performed in a low-temperature, low-humidity (15° C./15% RH) environment.

Image problems due to melt adhesion to the member are evaluated based on the level of vertical streaks on a solid black image.

Vertical streaks occur when the toner cannot withstand long-term use and melt adheres to the developing sleeve, so that charging and developing cannot occur in the melt adhesion sites. The specific evaluation standard is as follows. A rank of A, B or C is considered passing.

Evaluation Standard

A: No vertical streaks observed

B: Slight vertical streaks observed at edge of image

C: Slight vertical streaks observed

D: Obvious vertical streaks observed

Image problems caused by contamination of the member are evaluated based on the level of image defects appearing as white spots on a solid black image output after output of 100,000 sheets in the above image output test.

Image defects appearing as white spots occur when the external additive detaches during long-term use and forms aggregates on the electrostatic latent image bearing member, so that toner cannot be developed in those regions. The specific evaluation standard was as follows. The numbers in Table 3 are the numbers of image defects. A rank of A, B or C is considered passing.

Evaluation Standard

A: No image defects appearing as white spots

B: Fewer than 5 image defects appearing as white spots

C: From 5 to less than 10 image defects appearing as white spots

D: 10 or more image defects appearing as white spots

Examples 2 to 14, Comparative Examples 1 to 7

These were evaluated as in Example 1. The evaluation results are shown in Table 3.

TABLE 3

| | | Low-temperature low-humidity environment | | | | | | | |
|---|---|---|---|---|---|---|---|---|---|
| | | Cleaning performance | | Transfer efficiency | | Melt adhesion tomember | | Contamination of member | |
| Example No. | Toner No. | Rank | Number of sheets when defects occurred | Rank | Transfer efficiency [%] | Rank at 50000 sheets | Rank at 100000 sheets | Rank | Number of image defects |
| 1 | 1 | A | — | A | 99 | A | A | A | 0 |
| 2 | 2 | B | 13000 | A | 99 | A | B | A | 0 |
| 3 | 3 | B | 12000 | B | 95 | A | A | A | 0 |
| 4 | 4 | B | 12000 | A | 99 | A | A | A | 0 |
| 5 | 5 | A | — | B | 95 | A | A | A | 0 |
| 6 | 6 | B | 13000 | B | 96 | A | A | A | 0 |
| 7 | 7 | A | — | C | 94 | A | A | A | 0 |
| 8 | 8 | A | — | B | 95 | A | A | A | 0 |
| 9 | 9 | A | — | A | 98 | A | A | B | 3 |
| 10 | 10 | A | — | A | 99 | A | A | C | 7 |
| 11 | 11 | B | 14000 | C | 93 | A | C | A | 0 |
| 12 | 12 | A | — | B | 96 | A | B | A | 0 |
| 13 | 13 | B | 12000 | A | 98 | A | A | B | 4 |
| 14 | 14 | B | 12000 | A | 99 | A | A | C | 8 |
| C.E. 1 | 15 | C | 6000 | D | 89 | C | D | B | 4 |
| C.E. 2 | 16 | C | 8000 | D | 88 | B | B | A | 0 |
| C.E. 3 | 17 | D | 5000 | A | 98 | B | C | A | 0 |
| C.E. 4 | 18 | D | 3000 | A | 99 | B | B | A | 0 |
| C.E. 5 | 19 | A | — | D | 88 | B | B | A | 0 |
| C.E. 6 | 20 | D | 4000 | D | 88 | C | D | B | 4 |
| C.E. 7 | 21 | C | 10000 | D | 87 | A | B | A | 0 |

In the table, "C.E." denotes "Comparative Example".

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2018-246948, filed Dec. 28, 2018, which is hereby incorporated by reference herein in its entirety.

What is claimed is:

1. A toner, comprising:

a toner particle containing a binder resin; and an external additive containing an organosilicon polymer fine particle having an organosilicon polymer with a structure represented by at least one selected from the group consisting of $R^aSiO_{3/2}$ and $R^b{}_2SiO_{2/2}$, where $R^a$ and $R^b$ represent organic groups, wherein in a particle size distribution of the toner based on number, measured within a particle size range of 2 to 60 μm (i) the 50% particle diameter T-$D_{50n}$ is 6 to 12 μm, (ii) the number ratio of toner having particle size of 4 μm or less is 2 to 5% of the total toner within a particle size range of 2 to 60 μm and (iii) the number ratio of toner having particle size of 3 μm or less to toner having particle size of 4 μm or less is 25 to 37%, a number-average particle diameter P-$D_{50n}$, of the organosilicon polymer fine particle is 80 to 150 nm and $0.04 \leq P_{mass}/T_{3a} \leq 6.00$ where $T_{3a}$ represents a number percentage of toner having particle size of 3 μm or less in size accumulated from the smallest diameter in the number particle size distribution of the toner, and $P_{mass}$ represents a mass parts of the organosilicon polymer fine particle per 100 mass parts of the toner particle in. the toner.

2. The toner according to claim 1, wherein the organosilicon polymer fine particle has a structure of alternately binding silicon atoms and oxygen atoms, the organosilicon polymer has a T3 unit structure represented by $R^aSiO_{3/2}$ where $R^a$ represents a $C_{1-6}$ alkyl group or phenyl group, and the ratio of the area of peaks derived from silicon having the T3 unit structure relative to the total area of peaks derived from all silicon element contained in the organosilicon polymer fine particle is 0.90 to 1.00 in $^{29}$Si-NMR measurement of the organosilicon polymer line particle.

3. The toner according to claim 1, wherein the organosilicon polymer fine particle is a silsesquioxane particle.

4. A toner, comprising:

a toner particle containing a binder resin; and an external additive containing an organosilicon polymer fine particle having an organosilicon polymer with a structure represented by at least one selected from the group consisting of $R^aSiO_{3/2}$ and $R^b{}_2SiO_{2/2}$, where $R^a$ and $R^b$ represent organic groups, wherein in a particle size distribution. of the toner based on number, measured within. a particle size range of 2 to 60 μm (i) the 50% particle diameter T-$D_{50n}$ is 6 to 12 μm, (ii) the number ratio of toner having particle size of 4 μm or less is 2 to 4% of tie total toner within a particle size range of from 2 to 60 μm and (iii) the number ratio of toner having particle size of 3 μm or less to toner having particle size of 4 μm or less is 25 to 50%, a number-average particle diameter P-$D_{50n}$ of the organosilicon polymer Fine particle is 80 to 150 nm, and $0.04 \leq P_{mass}/T_{3a} \leq 6.00$ where represents a member percentage of toner having particle size of 3 μm or less in size accumulated from the smallest diameter in the number particle size distribution of the toner, and $P_{mass}$ represents a mass parts of the organosilicon polymer fine particle per 100 mass parts of the toner particle in the toner.

* * * * *